United States Patent [19]

Berndt et al.

[11] 4,094,472

[45] June 13, 1978

[54] CORE STRIPPING PROCESS FOR DEPLETED ROLLS OF NEWSPRINT PAPER

[75] Inventors: Robert Charles Berndt, Lutz; George B. Eady, Tampa, both of Fla.

[73] Assignee: Dar-Mar, Inc., Lutz, Fla.

[21] Appl. No.: 726,970

[22] Filed: Sep. 27, 1976

[51] Int. Cl.[2] ..... B65H 75/00

[52] U.S. Cl. ..... 242/54 R; 242/81

[58] Field of Search ..... 242/54 R, 58.3, 67, 242/60, 81, 55, 55.1

[56] References Cited

U.S. PATENT DOCUMENTS

| | | | |
|---|---|---|---|
| 1,905,464 | 4/1933 | Harris | 242/55.1 |
| 2,571,175 | 10/1951 | Williams | 242/60 |
| 2,736,507 | 2/1956 | Neese et al. | 242/55 |
| 2,772,838 | 12/1956 | Lenz | 242/55 |

FOREIGN PATENT DOCUMENTS

| | | | |
|---|---|---|---|
| 73,147 | 8/1916 | Switzerland | 242/60 |
| 241,635 | 8/1946 | Switzerland | 242/60 |

*Primary Examiner*—Leonard D. Christian
*Attorney, Agent, or Firm*—Theodore D. Lindgren

[57] ABSTRACT

A method for removal of newsprint paper remaining on cores after the majority of the rolled paper on the cores has been used for printing newspapers, the method comprised of emplacing the depleted roll with core in a cradle positioned parallel to an open-end, rotatable shaft with polished surface, partially uncoiling the depleted roll, then causing the paper to be transferred from the core to the rotating shaft, removing the paper from the open end of the shaft and disposing thereof, retaining the core for future use.

1 Claim, 3 Drawing Figures

CORE STRIPPING PROCESS FOR DEPLETED ROLLS OF NEWSPRINT PAPER

BACKGROUND OF THE INVENTION

1. Field of the Invention

This invention is associated with the field of newspaper printing, particularly as related to the process of removal of paper remaining on the cores of rolls of newsprint after removal from the newspaper printing machinery.

2. Description of the Prior Art

During the process of printing newspapers, it is common practice to replace the roll of newsprint paper prior to use of all of the paper on the roll. It is not uncommon for the roll removed to have a 3-to- 5 inch thickness of unused paper surrounding the core on which the roll of paper has been coiled.

The cores on which the paper is coiled are reusable and the unused paper is removed for recycling prior to shipment of the cores to the manufacturer of newsprint paper.

It is common practice to remove the layers of unused paper by first winding said paper on a device designed for the purpose of sawing through said layers with a motor-driven circular saw blade. While that method is effective, it produces excessive and hazardous amounts of dust which adversely affect the environment for both humans and nearby machinary.

SUMMARY OF THE INVENTION

The process of this invention provides a means for rapid and relatively dust-free removal of newsprint paper remaining on cores of depleted newsprint rolls after said rolls have been removed from newspaper printing machinery. The initial step in the process is the emplacement of a depleted newsprint roll in a cradle located in parallel proximity to a friction bar and an open-end, rotatable shaft with polished surface.

The second step in the process is to manually uncoil a part of the depleted roll of paper, attaching the exposed end of said paper to the parallel open-end shaft.

The third step is to rotate the open-end shaft, coiling the unused paper around it, at the same time removing said paper from the core of the depleted roll. During said rotation, the paper is slidably engaged with a friction bar located between said cradle and said open-end shaft.

The final step after the uncoiling of the paper from the core and the cessation of rotation of the open-end shaft is removal of the paper from said shaft by slidably shifting the rolled paper from the open end of the shaft.

Upon discarding the rolled paper, usually into a baling machine, and stacking the core with other cores for shipment to the paper manufacturer, the process is repeated.

DETAILED DESCRIPTION

Figure 1:
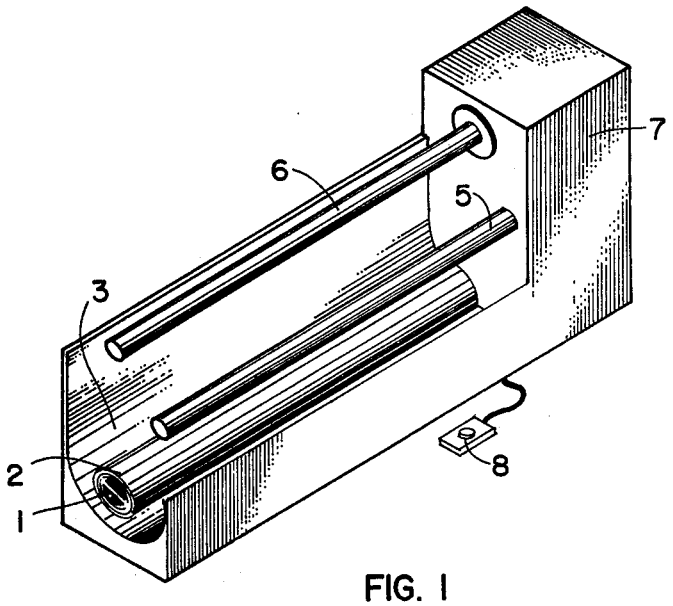
FIG. 1 is an isometric view indicating a configuration of machine elements used in the process of this invention.
Figure 2:
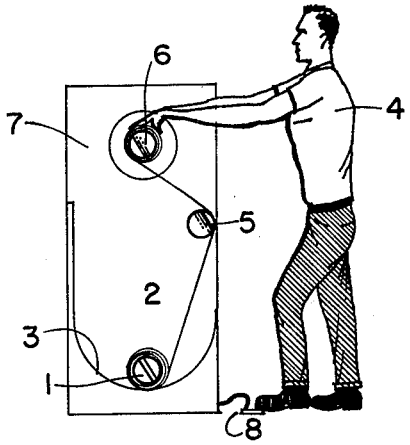
FIG. 2 is an end view of an apparatus used for the process of this invention, indicating the initial step taken by the operator in removal of paper from cores depleted rolls of newsprint.
Figure 3:
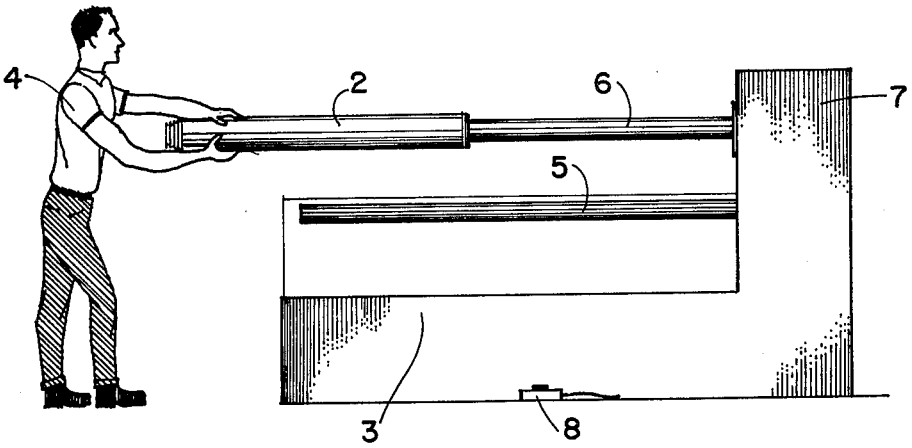
FIG. 3 is a side view of an apparatus used for the process of this invention, indicating the final step taken by the operator in removal of the paper from the polished-surface, rotatable shaft.

Reference is made to the drawings, briefly described in the foregoing section, wherein the same numerical designation is used in all three figures.

Rolls of newsprint paper are delivered to newpaper printers wound on re-usable cores 1. Remaining newsprint 2 is left upon core 1 after use of the majority of the roll of newsprint paper for the printing of newspapers by high-speed, automatic machinery. The newspaper printer must separate the paper 2 and the core 1, sending the paper 2 to be re-cycled and the core 1 to be re-used.

Previously the remaining newsprint paper from several cores 1 was wound on a spool, then cut from the spool with a motor-driven, circular saw blade mounted on a jig for that purpose. The rotating saw blade had a tendency to bind and, while operating, created an unhealthy amount of dust for the operator as well as persons and machinery located in near proximity.

The process of this invention utilizes a relatively dust-free, safe method for separating unused newsprint paper 2 from core 1.

Newsprint paper 2 on core 1 is placed in a cradle 3. More than one such depleted roll of newsprint may be place in cradle 3 at the same time.

The exposed end of newsprint paper 2 is pulled by the operator 4 in a manner such that it comes into contact with friction bar 5 prior to attachment to open-end, rotatable shaft 6. Cradle 3, friction bar 1 and shaft 6 are in held in fixed parallel relationship by the drive motor, housing and frame 7. Friction bar 1 is offset from the imaginary line connecting the centers of possible locations of core 1 and the center of shaft 6.

Operator 4 wraps the exposed end of newsprint paper 2 around shaft 6, at the same time causing shaft 6 to rotate by pressing switching means 8. Switching means 8 may be comprised of a footpedal or other operator-actuated mechanism. Preferably, the direction of rotation of shaft 6 is such that the top of the shaft 6 rotates toward the operator 4, enabling operator 4 to cause the exposed end of newsprint paper 2 to encircle said shaft 6. Operator 4, having caused the exposed end of newsprint paper 2 to completely encircle shaft 6, continues to cause said shaft 6 to rotate by continuing to actuate switching means 8 until such time as all of the newsprint from core 1 has been transferred to shaft 6.

Shaft 6 is preferably constructed of material such as steel or aluminum and the outer cylindrical surface of said shaft 6 is polished. During rotation of said shaft 6 for the purpose of winding newsprint paper 2 thereon, it is at times necessary for operator 4 to impart momentum to the paper 2 by momentarily physically pressing said paper 2 against said shaft 6. It has been found that one such initial imparting of momentum is usually sufficient for completion of the winding process.

After transfer of the newsprint paper from core 1 to shaft 6 is complete, operator 4 causes shaft 6 to cease rotation and removes newsprint paper 2 from shaft 6 by sliding said paper 2 from the open end of shaft 6 while said paper 2 remains in rolled configuration.

Thus, having completed separation of newsprint paper 2 from core 1, the operator 4 repeats the process of the invention, it is noted that the newsprint paper 2 is commonly baled while in rolled configuration for shipment to recycling centers. Cores 1 are stacked and bound together for shipment to newsprint manufacturers for re-use.

It is understood that the process of this invention is not limited to the precise method set forth but that it includes within its purview whatever changes fairly come within the terms of the appended claim.

We claim:

1. A method for separating newsprint paper from the core upon which it is wound, after said core and newsprint paper have been utilized in a newspaper printing process, comprising a. Starting with i. A core upon which a depleted amount of newsprint paper is wound, ii. A cradle, iii. An open-end, rotatable shaft located in parallel proximity to said cradle, iv. A friction bar located in parallel proximity to said cradle and shaft offset from any imaginary line drawn between the center of said shaft and the center of a core placed in any location in said cradle, v. A drive motor, housing and frame to which said shaft, cradle and friction bar are attached, and vi. A switching means for energizing said motor;

b. Placing said core with newsprint paper in said cradle;

c. Pulling the exposed end of said newsprint paper to slide over said friction bar then to surround said shaft;

d. Causing said shaft to rotate by activating said switching means and motor;

e. Transferring said newsprint paper from said core to said open-end shaft;

f. Causing said shaft to cease rotating by de-activating said switching means and motor; and g. Removing said newsprint paper while in rolled configuration from the open-end of said shaft.

* * * * *